US006966563B2

(12) United States Patent
Harrison

(10) Patent No.: US 6,966,563 B2
(45) Date of Patent: Nov. 22, 2005

(54) SAFETY DEVICE FOR SNOWBOARDS

(76) Inventor: Joshua C. Harrison, P.O. Box 2334, Newport Beach, CA (US) 92659

( * ) Notice: Subject to any disclaimer, the term of this patent is extended or adjusted under 35 U.S.C. 154(b) by 74 days.

(21) Appl. No.: 10/788,524

(22) Filed: Feb. 26, 2004

(65) Prior Publication Data

US 2004/0164520 A1 Aug. 26, 2004

Related U.S. Application Data

(62) Division of application No. 10/076,552, filed on Feb. 19, 2002, now Pat. No. 6,817,619.

(51) Int. Cl.[7] ..... A63C 9/00

(52) U.S. Cl. ..... 280/14.22; 280/14.23; 280/618

(58) Field of Search ..... 280/11.3, 11.31, 280/11.32, 11.33, 11.34, 14.21, 14.22, 14.23, 14.24, 607, 611, 616, 617, 618, 623, 626, 628, 634

(56) References Cited

U.S. PATENT DOCUMENTS 2,676,813 A * 4/1954 Joseph ..... 280/636
3,492,014 A * 1/1970 Von Besser ..... 280/618
3,802,714 A * 4/1974 Freegard ..... 280/607
3,834,723 A * 9/1974 Erlebach ..... 280/613
3,869,136 A * 3/1975 Jackson ..... 280/613
3,918,732 A * 11/1975 Wulf ..... 280/618
3,931,980 A * 1/1976 Marker ..... 280/611
4,191,395 A * 3/1980 Salomon ..... 280/613
4,629,208 A * 12/1986 Gertsch et al. ..... 280/618
4,741,550 A * 5/1988 Dennis ..... 280/618
4,792,155 A * 12/1988 Besnier ..... 280/607
4,869,522 A * 9/1989 Besnier et al. ..... 280/607
5,044,654 A * 9/1991 Meyer ..... 280/613
5,054,807 A * 10/1991 Fauvet ..... 280/607
5,354,088 A * 10/1994 Vetter et al. ..... 280/618
5,564,719 A * 10/1996 Kisselmann ..... 280/14.23
5,609,347 A * 3/1997 Dressel ..... 280/14.23
5,669,630 A * 9/1997 Perkins et al. ..... 280/613
5,695,210 A * 12/1997 Goss et al. ..... 280/624
5,758,895 A * 6/1998 Bumgarner ..... 280/607
5,762,357 A * 6/1998 Ratzek et al. ..... 280/607
5,782,475 A * 7/1998 Balmain ..... 280/14.22
5,791,678 A * 8/1998 Perlman ..... 280/618
5,810,381 A * 9/1998 Keller et al. ..... 280/623
5,820,155 A * 10/1998 Brisco ..... 280/607
5,857,700 A * 1/1999 Ross ..... 280/623
5,927,744 A * 7/1999 Knapschafer ..... 280/619
5,947,488 A * 9/1999 Gorza et al. ..... 280/14.21
6,022,040 A * 2/2000 Buzbee ..... 280/613
6,029,991 A * 2/2000 Frey ..... 280/618
6,145,868 A * 11/2000 Schaller et al. ..... 280/624
6,189,913 B1 * 2/2001 Morrow et al. ..... 280/613
6,196,559 B1 * 3/2001 Cress ..... 280/14.22
6,206,402 B1 * 3/2001 Tanaka ..... 280/607
6,209,904 B1 * 4/2001 Schnitzhofer ..... 280/616
6,279,924 B1 * 8/2001 Murphy et al. ..... 280/14.23
6,293,578 B1 * 9/2001 Anderson et al. ..... 280/624

FOREIGN PATENT DOCUMENTS

CA 2205913 * 11/1998

* cited by examiner

*Primary Examiner*—Christopher P. Ellis
*Assistant Examiner*—Christopher Bottorff

(57) ABSTRACT

A safety release mechanism for snowboards functions with standard contemporary snowboarding boots and bindings. Bindings that would normally be fastened to the snowboard are instead both fastened to a single binding support platform. A platform retention assembly, fastened to the snowboard, includes preloaded compliant members that form interfaces with contours on the binding support platform. The interfaces prevent the binding support platform from separating from the snowboard except when a force or torque applied to the snowboard exceeds a set threshold. The platform retention assembly also includes firm features that contact firm mating features on the binding support platform to prevent translation of the binding support platform relative to the platform retention assembly in the plane of the snowboard. The firm features and the firm mating features are arranged such that the contacts between them, when projected onto the plane of the snowboard, are all tangent about one mutual center point.

14 Claims, 19 Drawing Sheets

SAFETY DEVICE FOR SNOWBOARDS

REFERENCE TO CROSS RELATED APPLICATION

This application is a divisional of U.S. patent application Ser. No. 10/076,552 filed on Feb. 19, 2002 now U.S. Pat. No. 6,817,619, hereby incorporated herein by reference, and claims the benefit of the Feb. 19, 2002 filing date under 35 U.S.C. §121.

BACKGROUND OF THE INVENTION

1. Field of the Invention

The present invention relates generally to sports equipment. The present invention relates more particularly to equipment for the sport of snowboarding, and to safety devices used to prevent injury while snowboarding.

2. Background

Snowboarding is a winter sport that has gained in global popularity and is now commonly practiced at most ski resorts in the United States. Many Americans have already purchased equipment for snowboarding. This equipment usually includes a snowboard, snowboarding boots, and bindings to attach the snowboarding boots to the snowboard.

Two general types of snowboard bindings are owned by Americans today: "strap-in" snowboard bindings and "click-in" snowboard bindings. Both types of bindings are attached to the snowboard by threaded fasteners and are not removed from the snowboard during use. Neither type of binding is designed to separate from the snowboard under the force of a crash.

With strap-in bindings, the snowboarding boot is attached to the bindings by straps that must be connected and tightened. The straps must be loosened and/or disconnected to detach the snowboarding boots from the bindings. Strap-in bindings also serve to structurally reinforce the snowboarder's ankles while snowboarding (i.e. when the straps are tightened). Because the strap-in bindings provide the necessary rigidity around the snowboarder's ankles, the snowboarding boots need not be designed to be rigid or stiff. Therefore, the snowboarding boots that are designed to be compatible with strap-in bindings can be designed to be comfortable for normal walking. However, the feature facilitating comfortable boot design does not significantly enhance safety while snowboarding nor significantly reduce the chance of injury while snowboarding. Contemporary strap-in bindings are not designed to allow the separation of the boots from the snowboard under the force of a crash.

Click-in bindings better facilitate the intentional attachment and detachment of the snowboarding boots to and from the bindings. With click-in bindings, the snowboarding boots are specially designed or adapted to attach to the bindings, and detach from the bindings, upon a specific intentional action accomplished by the snowboarder. A snowboarder typically needs to detach one foot from the snowboard at the bottom of the ski slope to enable the snowboarder to push that foot against the snow for self-propulsion to the ski lift. The snowboarder must then reattach the disconnected foot to the snowboard after arriving at the top of the ski slope. Therefore, the ease of intentional detachment and reattachment can be an important performance characteristic of snowboard bindings. However, snowboarding boots that are specially designed to function with click-in bindings are typically very stiff because the boot must provide the ankle reinforcement necessary for snowboarding, without the additional structural support provided by strap-in bindings. Consequently such boots are less comfortable for walking than boots designed for use with strap-in bindings. Moreover, the feature facilitating intentional disconnection of the boots from the bindings does not significantly enhance safety nor significantly reduce the chance of injury. Contemporary click-in bindings are not designed to allow the separation of the boots from the snowboard under the force of a crash.

In contrast with snowboarding equipment, skiing equipment has evolved to include sophisticated safety release mechanisms in the bindings that attach ski boots to skis. These safety release mechanisms have prevented many ski-related injuries. However, such safety release mechanisms are absent in commercially available snowboarding equipment.

One reason why commercially available snowboard bindings have not yet evolved to include safety release mechanisms is the presence of at least one additional important design requirement: the need for simultaneous release of both bindings (one for each of the snowboarder's two feet) under the force of a crash. The release mechanisms that are typical of contemporary ski equipment do not satisfy that important design requirement. Therefore, there is a need for a practical safety release mechanism for snowboard bindings that can ensure simultaneous release of the bindings for both feet under the force of a crash. Furthermore, because of widespread fear among the purchasers of snowboarding equipment of the risk of injury associated with the release of only one snowboard binding and not the other, there is a commercial need for the safety release mechanism to provide clearly apparent and visually verifiable certainty in the simultaneity of the release.

Attempts have been made in the prior art to design a practical safety release mechanism for snowboard bindings. These designs seem to have been inspired by the safety release mechanisms developed for ski bindings, since their focus remains on the separation of each individual boot from all or part of its binding. The attempts have not contemplated a safety release that could separate standard snowboard bindings, including contemporary strap-in bindings, from the snowboard in response to the forces of a crash. Furthermore, prior art bindings for individual boots that release when that boot is twisted or lifted may not release when the snowboarder's entire trunk is twisted by the snowboard. When the torque applied by the snowboard to the snowboarder is about an axis normal to the snowboard, but is a torque about the longitudinal axis of the snowboarder's entire body rather than the twisting of an individual foot, prior art bindings for individual boots may perceive this torque as a lateral shear force in the plane of the snowboard and consequently may not release. Many snowboarders suffer injuries to their lower spine as a result of such torques. Thus, there is a need for a safety release mechanism that will release when a torque about an axis normal to the snowboard, but about the snowboarder's entire trunk rather than the twisting of an individual foot, exceeds a given threshold. Many prior art designs have been variants of click-in bindings that usually require the snowboarder to wear a specially designed or adapted boot. Many Americans have already purchased snowboard boots that they chose because of comfort, warmth, or style. Accordingly there is a need for a new safety release mechanism that will reduce the forces and torques applied to the snowboarder's legs and trunk during a crash, but will not render already-purchased snowboarding boots and bindings obsolete.

ADVANTAGES OF THE INVENTION

The disclosed invention provides a novel and effective safety device for snowboards. A preferred embodiment of the disclosed invention provides a safety release mechanism that has the advantage of being able to function with standard, already-purchased, contemporary snowboarding boots and bindings. Another advantage of the disclosed invention is that it provides a safety release mechanism that is responsive to crash forces and torques occurring in directions that are most likely to result in injury while snowboarding. For example, the disclosed invention has the advantage that it will release when a crash torque about an axis normal to the snowboard exceeds a given threshold, even where that torque is about trunk of the snowboarder's entire body rather than the twisting of an individual foot. A further advantage of the disclosed invention is that it provides a safety release mechanism having a force threshold for release that can be adjusted according to the magnitude of crash forces and torques that are expected for a particular snowboarder. For example, the force threshold for release can be adjusted according to the weight and ability level of the snowboarder. A further advantage of the disclosed invention is that it provides clearly apparent and visually verifiable certainty to a potential purchaser that, in the event of a crash, both bindings must always either release simultaneously or else not release at all. A further advantage of the present invention is that it provides a safety release mechanism that reduces the leverage that external objects can apply to the snowboarder's legs and trunk during and after a crash. A preferred embodiment of the present invention has the added advantage of continuing to prevent excessive spreading or crossing of the snowboarder's legs even after a safety release has occurred. Additional advantages and features of the invention will become apparent from the description that follows, and may be realized by means of the instrumentalities and combinations particularly pointed out in the appended claims.

SUMMARY OF THE INVENTION

According to one aspect of the invention, bindings that would normally be fastened to the snowboard are instead both fastened to a binding support platform. A platform retention assembly is fastened to the snowboard. The platform retention assembly includes preloaded compliant members that form interfaces with contours on the binding support platform. The interfaces prevent the binding support platform from separating from the platform retention assembly except when a force or torque applied to the snowboard exceeds a set threshold (i.e. except under crash conditions). The platform retention assembly includes firm members, surfaces, or edges that contact firm mating members, surfaces, or edges on the binding support platform to prevent pure translation of the binding support platform relative to the platform retention assembly in the plane of the snowboard. The firm members, surfaces, or edges, and the firm mating members, surfaces, or edges are arranged such that the contacts between them, when projected onto the plane of the snowboard, are all tangent about one mutual center point.

According to another aspect of the invention, a platform retention plate is fastened to the snowboard. The binding support platform is part of a binding support platform assembly that includes preloaded compliant members that form interfaces with contours on the platform retention plate. The interfaces prevent the binding support platform assembly from separating from the platform retention plate except when a force or torque applied to the snowboard exceeds a set threshold (i.e. except under crash conditions). The platform retention plate includes firm members, surfaces, or edges that contact firm mating members, surfaces, or edges on the binding support platform assembly to prevent pure translation of the binding support platform assembly relative to the platform retention plate in the plane of the snowboard. The firm members, surfaces, or edges, and the firm mating members, surfaces, or edges are arranged such that the contacts between them, when projected onto the plane of the snowboard, are all tangent about one mutual center point.

Different practical applications of the invention can enhance various metrics of performance. For example, according to one practical application of the invention, the preload force of three or more of the preloaded compliant members that facilitate retention of the binding support platform can be adjusted simultaneously by setting the position of a single centralized component. According to another practical application of the invention, snow and debris are excluded from the retention mechanism and interfaces by a cover. Yet, according to another practical application of the invention, longitudinal flexibility is enhanced by leaving the retention mechanism uncovered and thereby arriving at a lower profile design. According to another practical application of the invention, longitudinal flexibility is enhanced by separating the platform retention plate into two plates, or separating the plate underlying the platform retention assembly into two pieces (each fastened to the snowboard). According to another practical application of the invention, cost is reduced by limiting the number of preloaded compliant members to three. Yet, according to another practical application of the invention, four interfaces are located near the corners of the binding support platform to enhance the transfer of controlling torques from the snowboarder to the snowboard.

DETAILED DESCRIPTION OF THE PREFERRED EMBODIMENTS OF THE INVENTION

Figure 1:
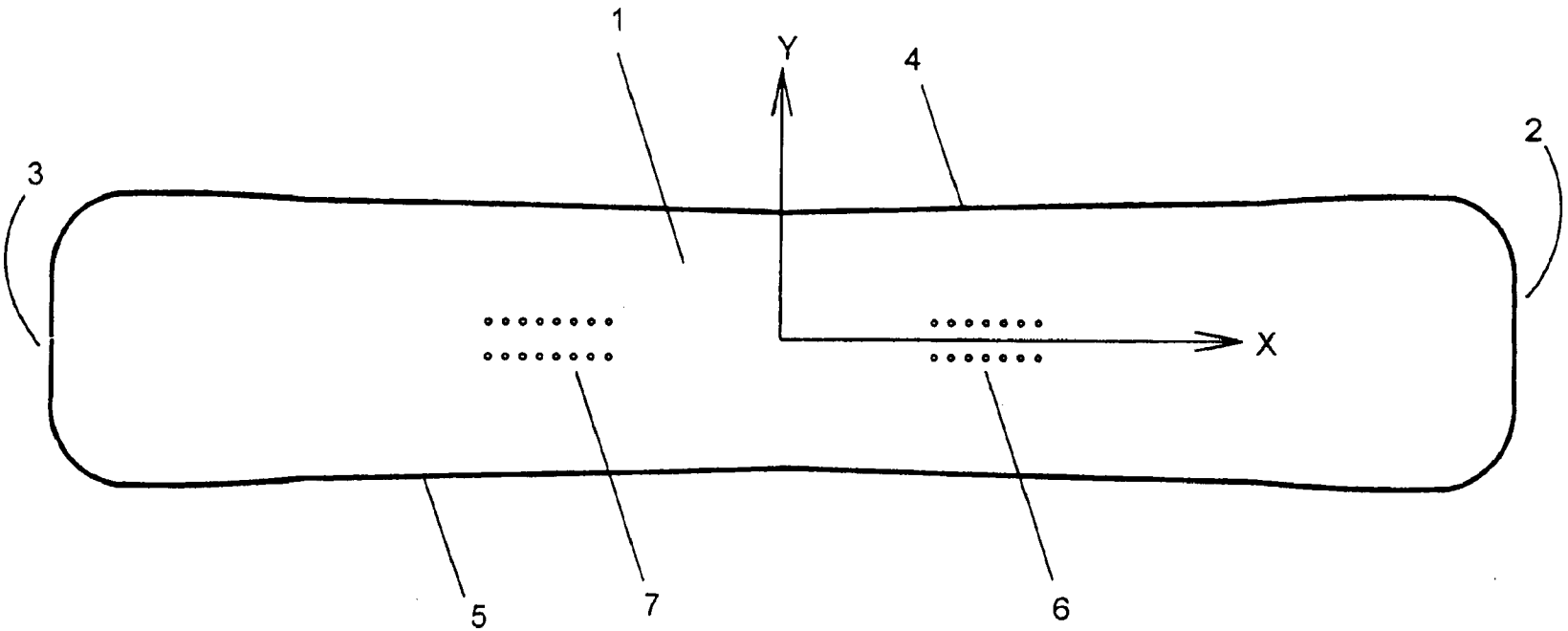
FIG. 1 (PRIOR ART)
FIG. 1 is a top view of a typical snowboard of the prior art.

Referring now to FIG. 1, a top view of a typical snowboard 1 of the prior art is shown. The snowboard 1 has a leading edge 2, a trailing edge 3, a left edge 4, and a right edge 5. Direction axis X and direction axis Y are indicated in FIG. 1, and will be used consistently when describing directions anywhere in this specification. Direction X always points longitudinally with respect to the snowboard, whereas direction axis Y always points laterally with respect to the snowboard. Both direction axis X and direction axis Y are parallel with, but not necessarily co-planar with, the top surface of snowboard 1. A leading group of shallow threaded holes 6 is provided to facilitate fastening of one binding to the snowboard, and a trailing group of shallow threaded holes 7 is provided to facilitate fastening of the other binding to the snowboard.

Figure 2:
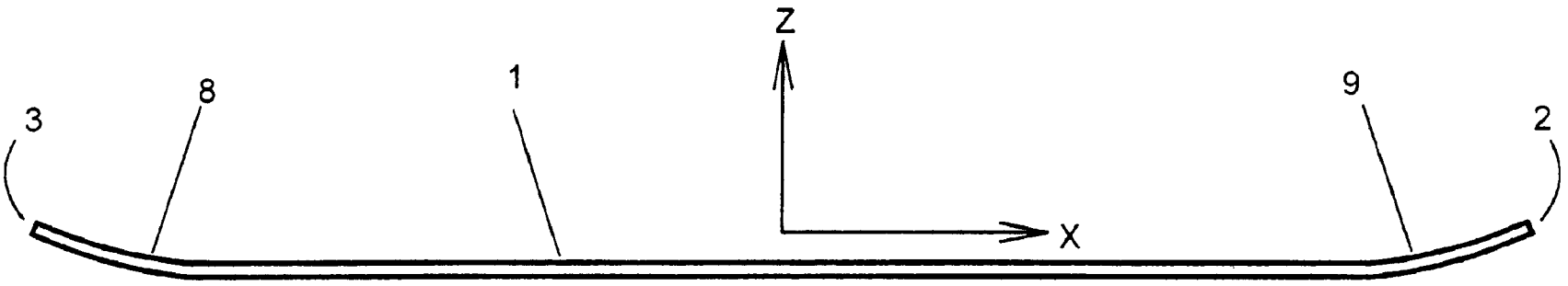
FIG. 2 (PRIOR ART)
FIG. 2 is a side view of a typical snowboard of the prior art.

FIG. 2 shows a side view of a typical snowboard 1 of the prior art. Direction axis Z and direction axis X are indicated in FIG. 2, and will be used consistently when describing directions anywhere in this specification. Direction Z always points vertically upwards with respect to the snowboard, and is normal to the top surface of snowboard 1.

Contemporary snowboards are designed to predominately facilitate sliding in the X and −X directions, but also to allow sliding in other directions. One way that sliding in the X and −X directions is preferentially facilitated by contemporary snowboard design is through choice of aspect ratio—that is, the snowboard is longer along the X axis than it is wide along the Y axis. Typical snowboard aspect ratios serve to enhance the interaction of edges 4 and 5 with the underlying snow or ice. A second way that sliding in the X and −X directions is preferentially facilitated by the snowboard design is by the existence of rocker curves 8 and 9. Rocker curves 8 and 9 prevent leading edge 2 and trailing edge 3 from interacting with the underlying snow or ice, and allow the snowboard to more easily travel over surface discontinuities when traveling in the X or −X direction.

Figure 3:
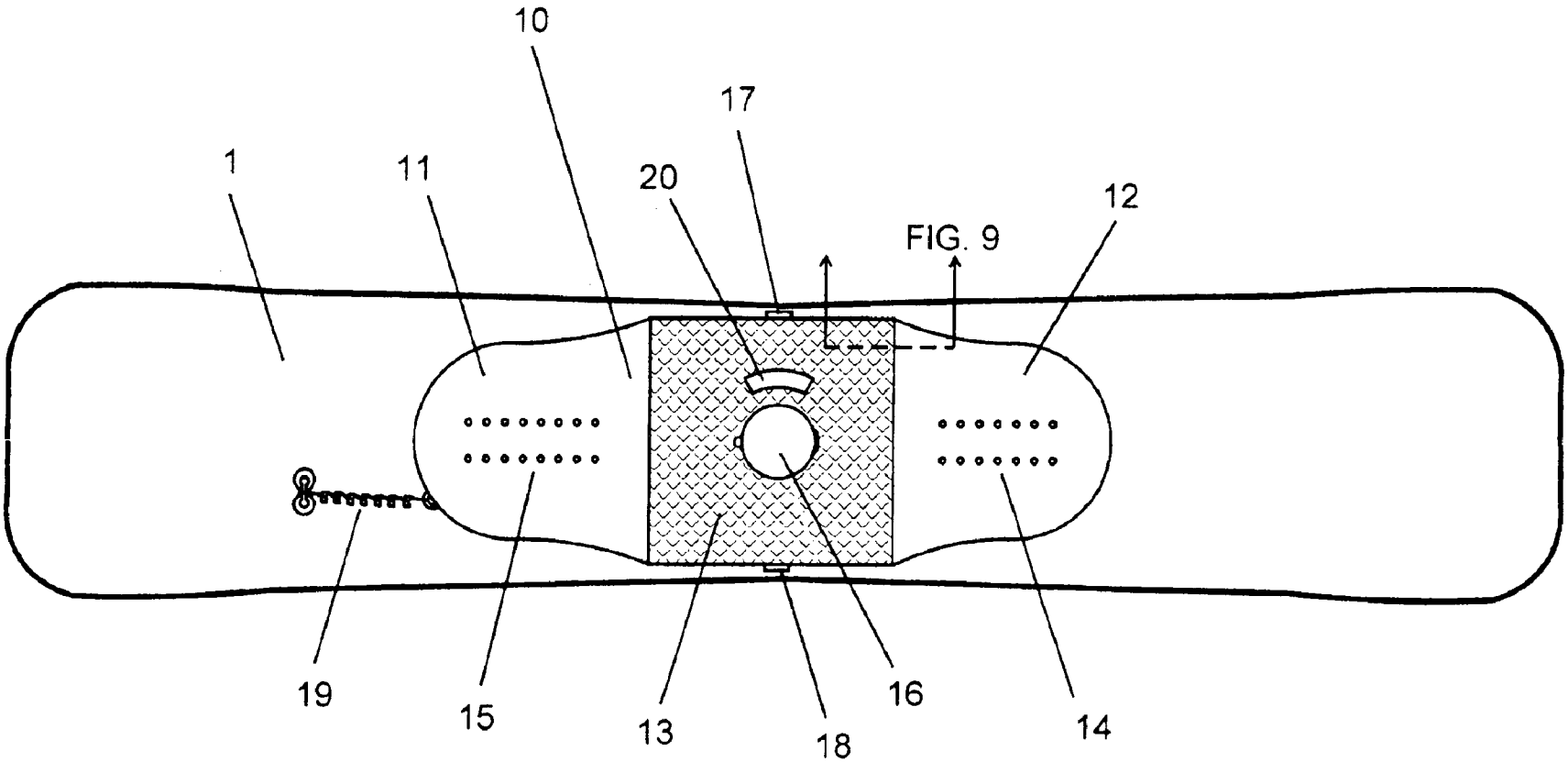
FIG. 3 is a top view of a preferred embodiment of the disclosed invention when mounted on a snowboard.
Figure 4:
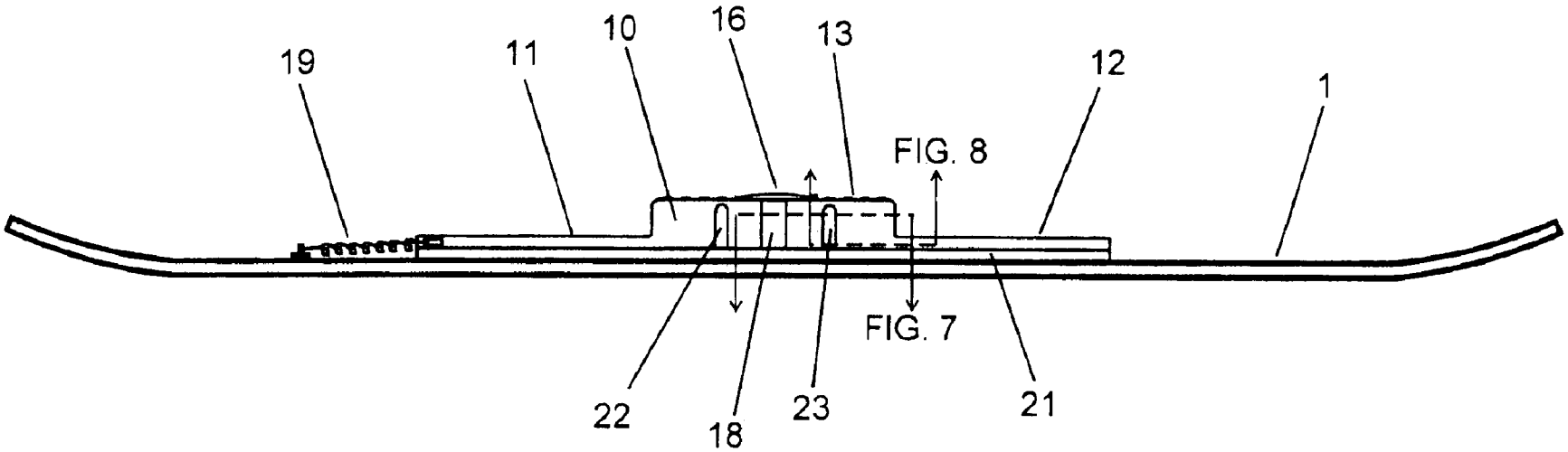
FIG. 4 is a side view of a preferred embodiment of the disclosed invention when mounted on a snowboard.

FIG. 3 shows a top view of a preferred embodiment of the disclosed invention when mounted on a snowboard. FIG. 4 shows a side view of the same preferred embodiment. The preferred embodiment includes a binding support platform 10 having regions 11, 12, and 13. The top surface of region 13 of the binding support platform is raised in the view of FIG. 3, relative to the top surface of regions 11 and 12. This relationship is apparent in FIG. 4. Region 11 of binding support platform 10 includes a group of shallow threaded holes 15 that are functionally similar to group 7 in the prior art. Region 12 of binding support platform 10 includes a group of shallow threaded holes 14 that are functionally similar to group 6 in the prior art. The shallow threaded holes of groups 14 and 15 facilitate the fastening of conventional bindings to binding support platform 10. The conventional bindings are then used to attach the snowboarder's boots to binding support platform 10 in the same way that conventional bindings are used to attach the snowboarder's boots to the snowboard in the prior art. The shape of regions 11 and 12 optionally can be changed from that shown, so long as an adequate structural medium is maintained in which to locate and support a fastening means for the bindings (e.g. a fastening means such as the threaded hole groups 14 and 15).

In a preferred embodiment, binding support platform 10 includes internal contours or facets in region 13 that interface with preloaded compliant members of an underlying platform retention mechanism. These interfaces serves to retain the binding support platform on the snowboard during normal use (i.e. except when crash forces exceed a certain threshold). In that preferred embodiment, the platform retention mechanism underlying region 13 is a separate assembly that includes plate 21 and remains fastened to the snowboard even if binding support platform 10 separates from the retention mechanism under crash conditions.

In the embodiment of FIG. 3, region 13 of the binding support platform is optionally designed to also serve as a cover to exclude snow and debris from the region of the retention mechanism. The cover need not be square in shape; its shape could be rounded or otherwise externally styled around or above the retention mechanism. An access hole that facilitates adjustment and setting of release force threshold is optionally covered by cap 16 to exclude snow and other debris. Binding support platform 10 optionally includes a separate window 20 through which to view threshold release force adjustment and setting.

Region 13 of the binding support platform need not serve any dual purpose as a cover; rather, region 13 optionally can be made lighter and more flexible by intentionally including holes and other regions of reduced coverage. There is also considerable design freedom in choosing the thickness and material for the binding support platform. Suitable materials include composite materials such as fiberglass, carbon fiber reinforced epoxy, and other fiber reinforced composites, high strength plastics, and metals. Furthermore, the designer has the freedom to use changes in geometry, such as localized changes in thickness, holes, slots, and ribs, in order to reach an engineering compromise between the need for high lateral and torsional stiffness in certain areas of the binding support platform, versus the desired characteristic of longitudinal flexibility over its total length.

The aforementioned engineering compromise can be more specifically described by reference to FIG. 3. In the preferred embodiment shown, there is a need for high lateral and torsional stiffness in the area between the group of shallow holes 14 and the two leading interior corners of region 13 of binding support platform 10. There is also a need for high lateral and torsional stiffness in the area between the group of shallow holes 15 and the two trailing interior corners of region 13 of binding support platform 10. However, longitudinal compliance to flexing of the underlying snowboard is desired over the length of the binding support platform. The preferred embodiment shown in FIG. 3 and FIG. 4 shows an example of changes in geometry that can be made to enhance the outcome of the aforementioned engineering compromise. The preferred embodiment shown in FIG. 3 and FIG. 4 optionally includes vertical stiffening ribs 17 and 18, and vertical slots 22–25 on the sides of the binding support platform 10 in region 13. Optional vertical slots 22–25 are included to enhance the overall longitudinal flexibility of this preferred embodiment without sacrificing lateral or torsional stiffness in the aforementioned regions where such stiffness is desired. Optional stiffening ribs 17 and 18 increase the lateral stiffness of the bottom edge of the binding support platform 10 in region 13, to compensate for an undesired increase in lateral flexibility of the bottom edge that would otherwise result from the inclusion of vertical slots 22–25.

The top surface of region 13 can optionally include traction-enhancing texturing or holes, slip resistant pads or matting, and/or adhesive. Such traction enhancing surfaces may be used to reduce slippage when surface 13 is incidentally or intentionally stepped on for balance (or rest) while the snowboarder uses one detached foot for self-propulsion. Region 13 of binding support platform 10 is shown with a traction enhancing texture in the embodiment of FIG. 3 and FIG. 4.

A preferred embodiment of the disclosed invention includes an optional leash 19 that is shown in FIG. 3 and FIG. 4 having one end attached to the snowboard and the other end attached to the binding support platform. Leash 19 is intended to prevent runaway of the snowboard too far from the snowboarder if the binding support platform (to which the snowboarder is attached) separates from the snowboard during a crash. It is possible to attach one end of optional leash 19 to plate 21 of the platform retention assembly rather than to the snowboard. It is also possible to attach the other end of optional leash 19 to a binding or to the snowboarder rather than to binding support platform 10.

Figure 5:
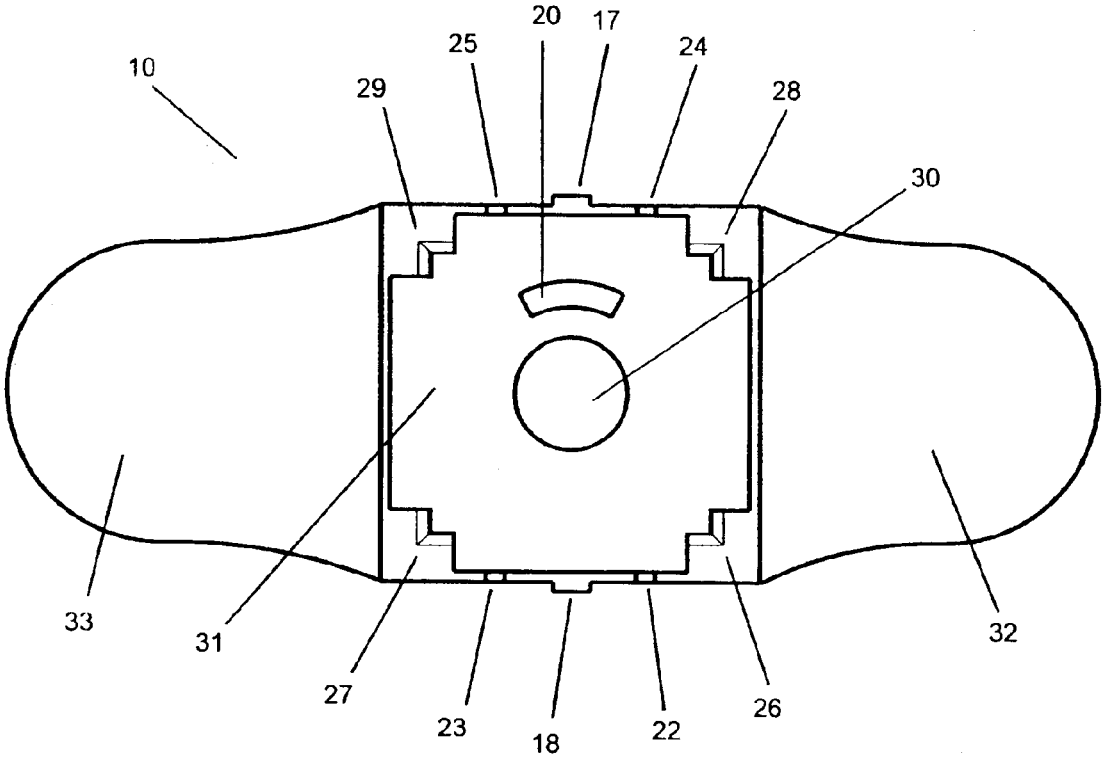
FIG. 5 is an underside view of the binding support platform in a preferred embodiment of the disclosed invention.

FIG. 5 shows the underside of the binding support platform of the same preferred embodiment that is shown in FIG. 3 and FIG. 4. Surface 32 is the underside of region 11. Surface 33 is the underside of region 12. Surface 31 covers the underside of region 13, and is recessed in this view. Cover surface 31 is included optionally to exclude snow and other debris, however it is also an important structural member in this particular embodiment because of the presence of optional vertical slots 22–25. In this preferred embodiment, interior corners 26–29 of the binding support platform include three dimensional contours or facets for interfacing with a retention mechanism that will be described below. In this preferred embodiment, binding support platform 10 is a single piece frame with no moving parts. Access hole 30 through optional cover surface 31 can be seen in FIG. 5 although it was covered by optional cap 16 in FIG. 3.

Figure 6:
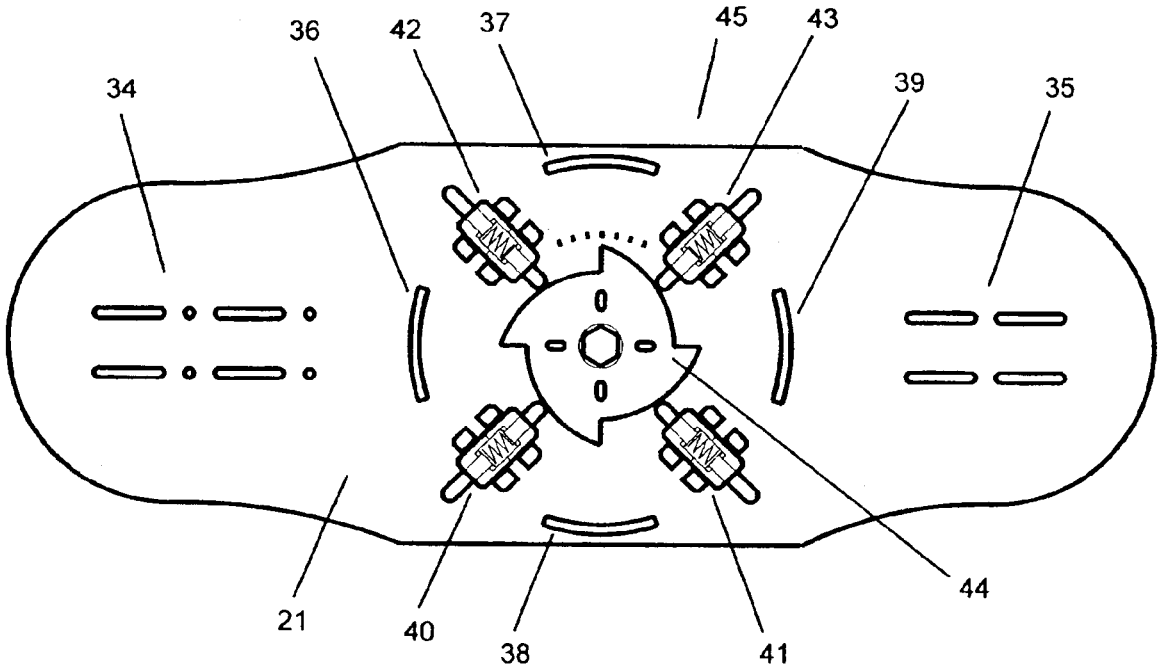
FIG. 6 is a top view of the platform retention assembly in a preferred embodiment of the disclosed invention.

FIG. 6 shows a top view of the platform retention assembly in a preferred embodiment of the disclosed invention. Underlying plate 21 holds together platform retention assembly 45 in this embodiment. There is considerable design freedom in choosing the thickness and material for underlying plate 21, so as to arrive at an engineering compromise between the need for adequate stiffness and the desired characteristic of overall longitudinal flexibility, subject to cost constraints imposed by the market for the product. A practical choice having low cost is to select a thin sheet of spring steel. Groups 34 and 35 of through-holes and slots are positioned and dimensioned to facilitate fastening of plate 21 to groups 6 and 7 of shallow threaded holes on the top surface of snowboard 1. If special fasteners, that allow sliding in the X direction but do not allow separation in the Z direction, are used in the slots of group 35 while standard fasteners are used in group 34, then the overall longitudinal flexibility of the preferred embodiment can be practically enhanced. Examples of standard fasteners include standard bolts and machine screws. An example of a special fastener is a modified machine screw having a lower threaded portion and an upper unthreaded portion. The lower threaded portion has a smaller diameter than the upper unthreaded portion. The boundary between the lower threaded portion and the upper unthreaded portion serves as an insertion stop or limiter that limits insertion of the machine screw as it is tightened. The upper unthreaded portion is capped by a driving head that protrudes radially sufficiently to prevent Z motion of plate 21, and the unthreaded portion itself is dimensioned to allow X direction sliding motion of slots in group 35 but to prevent Y direction sliding. Such dimensioning is obtained if the upper unthreaded portion of the special fastener has a diameter nearly equal to the width of one individual slot in group 35—a dimensioning well known in the art as a "slip fit."

In the preferred embodiment of FIG. 6, raised ribs 36–39 rise in the Z direction from the surface of plate 21. Ribs 36–39 can be separate parts attached to plate 21 by standard fasteners such as machine screws inserted from the back of plate 21, by welding, or by a strong adhesive in the case where ribs 36–39 are fitted into recessed groves in plate 21 to increase the shear strength of the bond. Alternatively, plate 21 can be molded or formed to include ribs 36–39 as a single part. Since ribs 36–39 of the preferred embodiment of FIG. 6 are curved, if the ribs are to be manufactured by press forming then holes may be required in plate 21 to prevent warping and other distortion of the plate. The outside edges of ribs 36–39 contact the inside edges of region 13 of binding support platform 10, preventing "pure" lateral and longitudinal motion of binding support platform 10 in the X-Y plane relative to plate 21. What is meant by "pure" lateral and longitudinal motion of binding support platform 10 in the X-Y plane, is lateral or longitudinal motion relative to plate 21 occurring without separation of binding support platform 10 away from plate 21 in the Z direction. The ribs 36–39 do not, by themselves, prevent motion of binding support platform 10 relative to plate 21 in the Z direction. In the preferred embodiment shown in FIG. 6, ribs 36–39 are curved and arranged in a single circle in the X-Y plane so that they do not, by themselves, prevent rotation of binding support platform 10 relative to plate 21 about the Z axis. The ribs 36–39 are also given some vertical curvature in the outer surface of their cross-sectional aspect so that they do not, by themselves, prevent rotation of binding support platform 10 relative to plate 21 about the X axis or Y axis (as would occur if binding support platform 10 separated from plate 21 as a result of a torque about the X axis or Y axis). In another preferred embodiment, ribs 36–39 are replaced by discrete pegs rising from the surface of plate 21 and having outside edges that are arranged to be tangent about one mutual center point in the X-Y plane.

Figure 7:
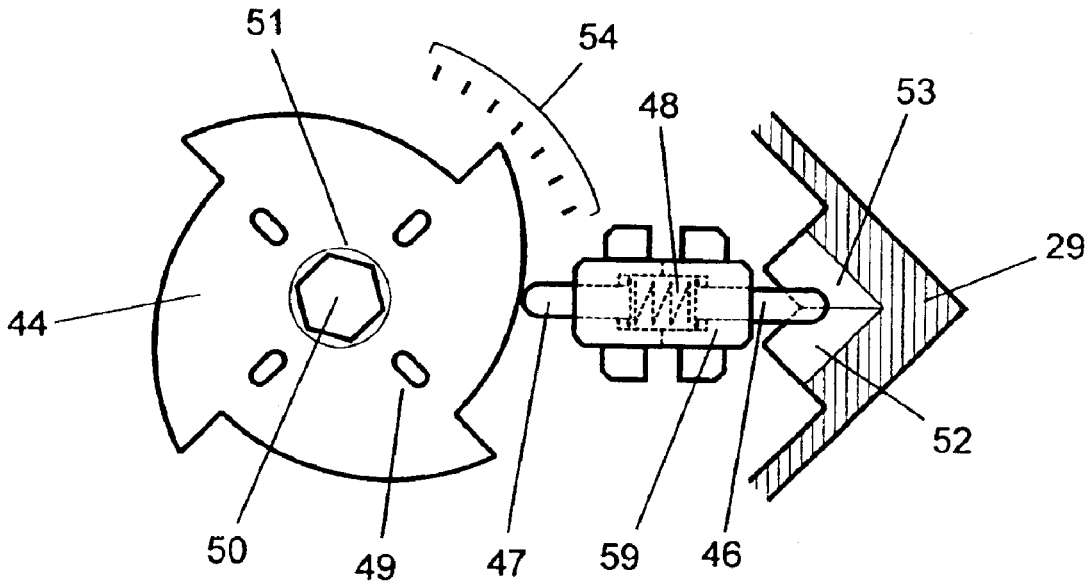
FIG. 7 is a cross-sectional illustration of the adjustable and releasable connection between the platform retention assembly and one interior corner of the binding support platform in a preferred embodiment of the disclosed invention, as viewed from above.

In the preferred embodiment of FIG. 6, adjustable preloaded plunger assemblies 40–43 are part of platform retention assembly 45 and are fastened to plate 21. In this embodiment, the preload forces of all plunger assemblies are simultaneously adjusted by the rotation and locking of a single adjustment cam 44. However, in another embodiment the preload force of each plunger assembly is individually adjusted, for example, by turning and locking a threaded adjustment plunger. In the embodiment of FIG. 6 and FIG. 7, the locked position of adjustment cam 44 corresponds to the setting of release force threshold, with such setting observable on scale 54 which is comprised of marks on the surface of plate 21.

FIG. 7 is a cross-sectional illustration of the adjustable and releasable connection between platform retention assembly 45 and one interior corner of binding support platform 10 in a preferred embodiment of the disclosed invention, as viewed from above. The hatched area is a cross section (in an X-Y plane) of inner corner 29 of the binding support platform, as viewed from above. We see in this view that each preloaded plunger assembly in the preferred embodiment of FIG. 7 includes a housing 59, a spring 48, a sliding adjustment plunger 47, and a sliding retention plunger 46. In this embodiment, the adjustment cam 44 is designed to be rotated using a forked tool having two or three prongs that mate with opposing radial slots such as slot 49 in cam 44. Adjustment cam 44 is locked into place by the action of a locking mechanism such as bolt 50 and lock washer 51.

In the preferred embodiment of FIG. 7, preloaded spring 48 presses the retention plunger 46 against tilted facets 52 and 53. Tilted facets 52 and 53 form part of a three dimensional contour adjacent to inner corner 29 of binding support platform 10. In the embodiment of FIG. 7, facets 52 and 53 are seen to form a 90° interior angle with respect to each other in the X-Y plane. However, facets 52 and 53 could be oriented to have any interior angle with respect to each other in the X-Y plane less than 180° but large enough to accept plunger 46. Larger angles in the X-Y plane enable release of binding support platform 10 at lower torques about the Z axis, whereas smaller angles raise the release threshold for torques about the Z axis.

In the preferred embodiment of FIG. 7, facets 52 and 53 are also tilted with respect to the Z axis so that retention plunger 46 will impart a retention force to binding support platform 10 that can resist limited separation forces in the Z direction and therefore also resist limited separation torques about the X axis and Y axis. If facets 52 and 53 were not tilted with respect to the Z axis, but were instead made parallel to the Z axis, then the only retention force available to resist vertical separation forces and torques would be the force of friction at the interface between the facets and retention plunger 46. However, when facets 52 and 53 are oriented in the design to form an angle relative to the Z axis, that angle grossly affects the vertical force or torque that is required to overcome the force imparted by retention plunger 46. The specifics of this effect will be described in greater detail below, with reference to FIG. 9.

Based on the foregoing description, it should now be apparent to a skilled artisan that selection of the angular orientation of facets 52 and 53 gives the designer the freedom to predetermine a ratio of release thresholds for out-of-plane torque versus in-plane torque, within a wide range. The absolute release threshold for both can then be easily adjusted by the user by adjustment of cam 44 (within a range set by the designer through selection of the stiffness and length of spring 48 and the stroke of adjustment cam 44).

Figure 8:
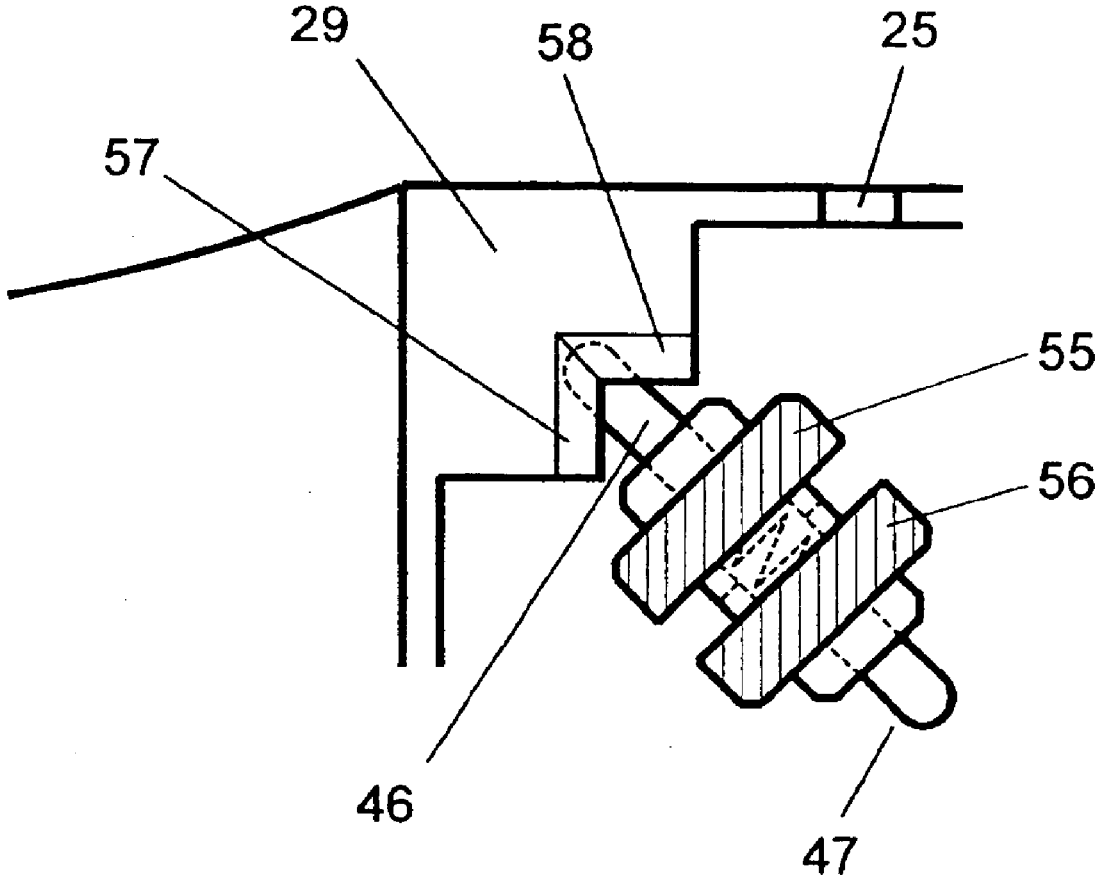
FIG. 8 is a cross-sectional illustration of the connection between the platform retention assembly and one interior corner of the binding support platform in a preferred embodiment of the disclosed invention, as viewed from below.

FIG. 8 is a cross-sectional illustration of the connection between platform retention assembly 45 and interior corner 29 of binding support platform 10, as viewed from below in a preferred embodiment. Structural supports 55 and 56 for a preloaded plunger assembly are seen in cross-section in FIG. 8, as viewed cut away in an X-Y plane from plate 21. Facets 57 and 58 of interior corner 29 of binding support platform 10 are visible in FIG. 8, because facets 57 and 58 are visible from below in this embodiment. It should be clearly understood that facets 57 and 58 are not the same as facets 52 and 53. Facets 52 and 53 are not visible from below; rather facets 52 and 53 would be visible from above in the preferred embodiment if not obscured by the top surface of region 13 of binding support platform 10. Unlike facets 52 and 53, facets 57 and 58 do not affect the threshold release forces and torques in this preferred embodiment. Rather, facets 57 and 58 serve only to enable forcible reattachment of binding support platform 10 onto platform retention assembly 45 (for example, after a release), without requiring the user to first loosen cam 44. To accomplish such forcible reattachment, the user first positions binding support platform 10 over platform retention assembly 45 such that facets 57 and 58 of each interior corner rest on the tips of the plurality of retention plungers 46, and then the user presses down on binding support platform 10 (usually by standing or jumping on it) so that it is forced in the −Z direction. After forcible reattachment, the plurality of retention plungers 46 are no longer in contact with facets 57 and 58 of each interior corner of the binding support platform; rather, the retention plungers are again spring loaded against facets 52 and 53 of each interior corner. The specifics of this change will be described in greater detail below, with reference to FIG. 9.

Figure 9:
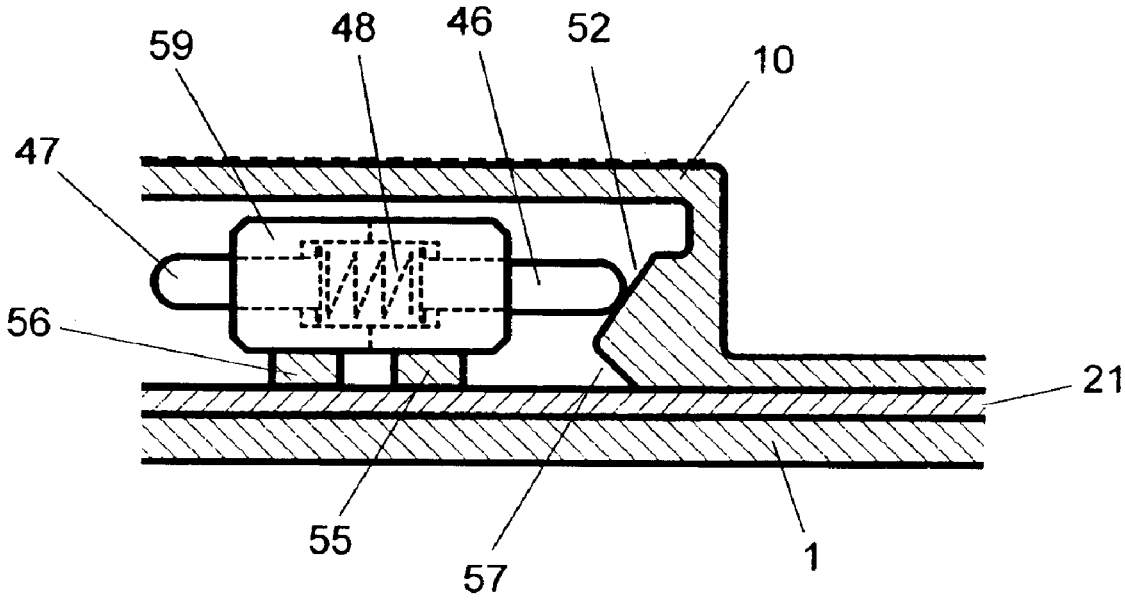
FIG. 9 is a simplified cross-sectional illustration of the interface between the platform retention assembly and a contour of one interior corner of the binding support platform in a preferred embodiment of the disclosed invention, as viewed from the side.

FIG. 9 is a simplified cross-sectional illustration of the interface between platform retention assembly 45 and a single facet 52 of a contour in one interior corner of binding support platform 10, as viewed from the side. FIG. 9 is described as "simplified" for four reasons. First, interior corner 29 of binding support platform 10 is viewed in cross-section but the retention plunger 46 is not. The cross section is taken in an X-Z plane near the point where retention plunger 46 touches facet 52. Second, retention plunger 46 appears in FIG. 9 as it would appear if it contacted facet 52 at a point on the plunger's vertical longitudinal bisecting plane. However, according to the aforedescribed preferred embodiment, retention plunger 46 contacts facet 52 at a point on a non-vertical longitudinal bisecting plane of the plunger. Third, the plunger assembly in FIG. 9 is shown in a pure side view, as if the plunger assembly housing 59 were oriented parallel to the X axis. Actually, the plunger assembly may be at a significant angle with respect to the X axis in a preferred embodiment, so as to appear shorter in FIG. 9 if the figure were not simplified. For example, in the preferred embodiment shown in FIG. 6 and FIG. 8, the plunger assemblies 40–43 are oriented at 45° angles with respect to the X axis. Fourthly, all lines representing adjacent facets 53 and 58 have been eliminated to present an uncluttered and simple illustration of the interface of plunger 46 with a single facet. FIG. 9 shows (in simplified view) how, in a preferred embodiment, the interface between retention plunger 46 and facet 52 helps to retain one interior corner of binding support platform 10 against the action of a limited separating torque or force in the Z direction. However, the simplifications made to FIG. 9 prevent it from showing how the interfaces between retention plunger 46 and facets 52 and 53 serve to resist limited torques about the Z axis. That aspect of the aforedescribed preferred embodiment was more clearly described earlier with reference to FIG. 7.

Referring now to FIG. 9, it can be seen that facet 52 of a preferred embodiment is tilted with respect to the vertical (Z) axis. If facet 52 were not tilted with respect to the Z axis, but were instead made vertical (parallel to the Z axis), then the only retention force produced by the interface (of retention plunger 46 and facet 52) to resist vertical separation forces and torques would be the force of friction. However, when facet 52 is oriented in the design to form an angle relative to the Z axis, that angle grossly affects the vertical force or torque that is required to overcome the force imparted by retention plunger 46. Specifically, if the angle of facet 52 is tilted in the design to appear steeper as viewed in FIG. 9, then the retention threshold for vertical separation forces and torques will be reduced. Conversely, if the angle of facet 52 is tilted in the design to appear less steep as viewed in FIG. 9, then the retention threshold for vertical separation forces and torques will be increased.

FIG. 9 also more clearly shows how a single facet 57 can contribute to the previously described attribute of this preferred embodiment that binding support platform 10 is capable of forcible reattachment to platform retention assembly 45. To accomplish forcible reattachment, the user first places binding support platform 10 on platform retention assembly 45 such that facet 57 is resting on top of retention plunger 46. Next, the user presses down on binding support platform 10 so that retention plunger 46 is momentarily forced to the left (as viewed in FIG. 9), and then, as the retention plunger again moves to the right, the point of contact between retention plunger 46 and binding support platform 10 moves from facet 57 to facet 52. If the designer chooses a material for fabricating binding support platform 10 that has insufficient stiffness or toughness to prevent unacceptable wear or distortion at the locations where contact is made with retention plungers 46 (for example, wear occurring after several forcible reattachments), then the facets or three dimensional contours can be made of, covered by, plated with, or coated with a different material having better wear characteristics.

Figure 10:
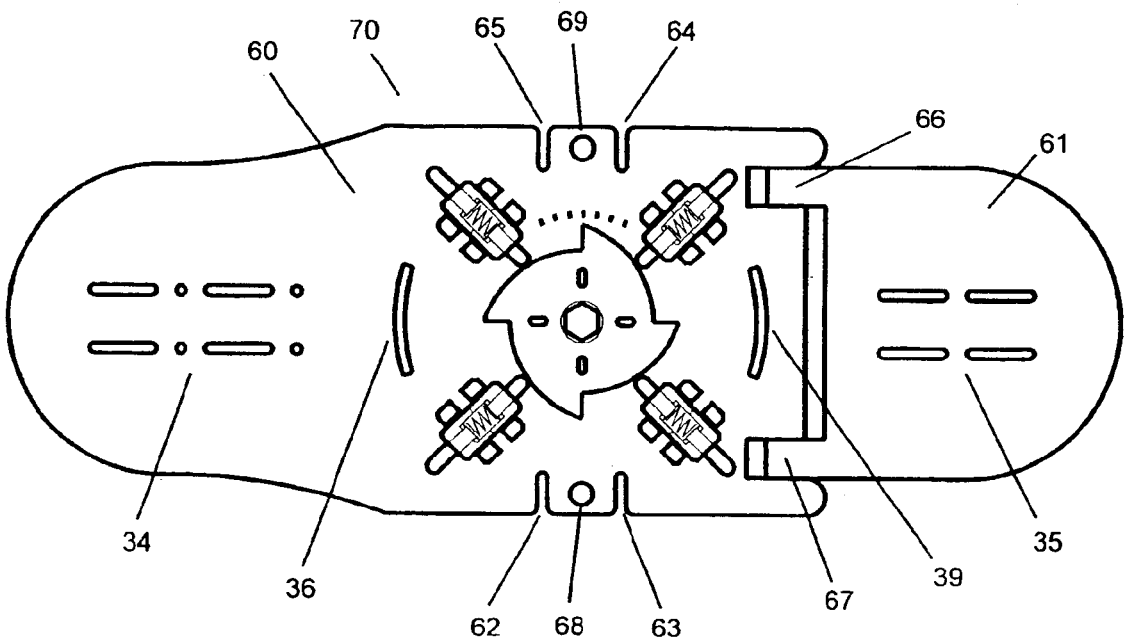
FIG. 10 is a top view of a platform retention assembly in a preferred embodiment of the disclosed invention that better accommodates longitudinal bending while reducing torque backlash.

FIG. 10 description shows a platform retention assembly 70 of an alternative embodiment of the disclosed invention that has increased longitudinal flexibility. Platform retention assembly 70 includes a two-piece underlying plate having plate pieces 60 and 61 connected by sliding joints 66 and 67. The cross-sectional profile of sliding joints 66 and 67 is fashioned to include a mating groove or step that allows sliding in the X direction but prevents relative motion in the Z direction and Y direction between plate pieces 60 and 61. Alternatively, plate piece 61 could be fashioned to include local overhanging top plates or protrusions in the regions of the sliding joints, to overlap plate piece 60 and prevent it from lifting in the Z direction relative to plate piece 61 in the regions of the sliding joints. The sliding joints 66 and 67 allow sliding in the X direction to enhance the longitudinal flexibility of platform retention assembly 70 when standard fasteners are used to fasten the slots of groups 34 and 35 to the snowboard. In contrast with the embodiment of FIG. 6 where special fasteners are optionally used to enable sliding in the X direction at slots 35, the embodiment of FIG. 10 spreads out the points of siding contact laterally (in the Y direction). When the points of sliding contact are spread laterally, the clearance that is necessary to permit sliding in the sliding joint will cause less backlash in the torque transfer from rider to snowboard during normal use than it would if the points of sliding contact were closer together. Lateral spreading of the points of sliding contact is therefore desirable because it enhances the snowboarder's ability to control the snowboard by applying torques through the safety device to the snowboard with less backlash.

The embodiment of FIG. 10 also better facilitates longitudinal bending because ribs 37 and 38 have been replaced by vertical pegs 68 and 69 that have a shorter longitudinal dimension (i.e. shorter dimension along the X axis). Like ribs 37 and 38, vertical pegs 68 and 69 resist pure lateral sliding of the binding support platform, and are positioned in a circular arrangement with ribs 36 and 39 to permit rotation about the Z axis. Vertical pegs 68 and 69 are also given some vertical curvature (i.e. their outside surface that is slightly curved in the Y-Z plane) so as to permit lifting of one edge of binding support platform 10 in the Z direction (as would occur if binding support platform 10 separated from the snowboard as a result of a torque about the X axis). Slots 62–65 also help facilitate longitudinal bending of plate piece 60 in the embodiment of FIG. 10.

Another preferred embodiment that better facilitates longitudinal bending is shown in FIGS. 11–14. Longitudinal bending is facilitated in the preferred embodiment of FIGS. 11–14 because region 13 of binding support platform 71 does not protrude in the Z direction relative to the level of regions 11 and 12. The low vertical profile of binding support platform 71 in the embodiment of FIGS. 11–14 is achieved because the binding support platform does not cover preloaded plunger assemblies 74–77. Preloaded plunger assemblies 74–77 are fastened to underlying plates 72 and 73 in this embodiment. Underlying plates 72 and 73 are fastened to the snowboard by standard fasteners passing through holes and/or slots in groups 34 and 35 and anchoring in shallow threaded holes of groups 6 and 7 in snowboard 1. Underlying plates 72 and 73 longitudinally extend beyond of the leading and trailing edges of binding support platform 71 in this embodiment, and preloaded plunger assemblies 74–77 are fastened to areas of underlying plates 72 and 73 that are not covered by binding support platform 71. Whereas the preferred embodiments shown in FIGS. 5–8, and FIG. 10 included preloaded plunger assemblies that were located within region 13 and that were oriented to have their retention plungers pointed outward, the preloaded plunger assemblies 74–77 of the preferred embodiment shown in FIGS. 11–14 are located outside of region 13 and are oriented to have their retention plungers pointing inward. Because of the location and orientation of preloaded plunger assemblies 74–77, the preferred embodiment shown in FIGS. 11–14 does not include a single adjustment cam capable of simultaneously adjusting the preload force of each plunger assembly. Instead, the preload force of each plunger assembly 74–77 is individually adjusted in the embodiment of FIGS. 11–14 by turning and locking a threaded adjustment plunger pertaining to each preloaded plunger assembly 74–77.

Figure 11:
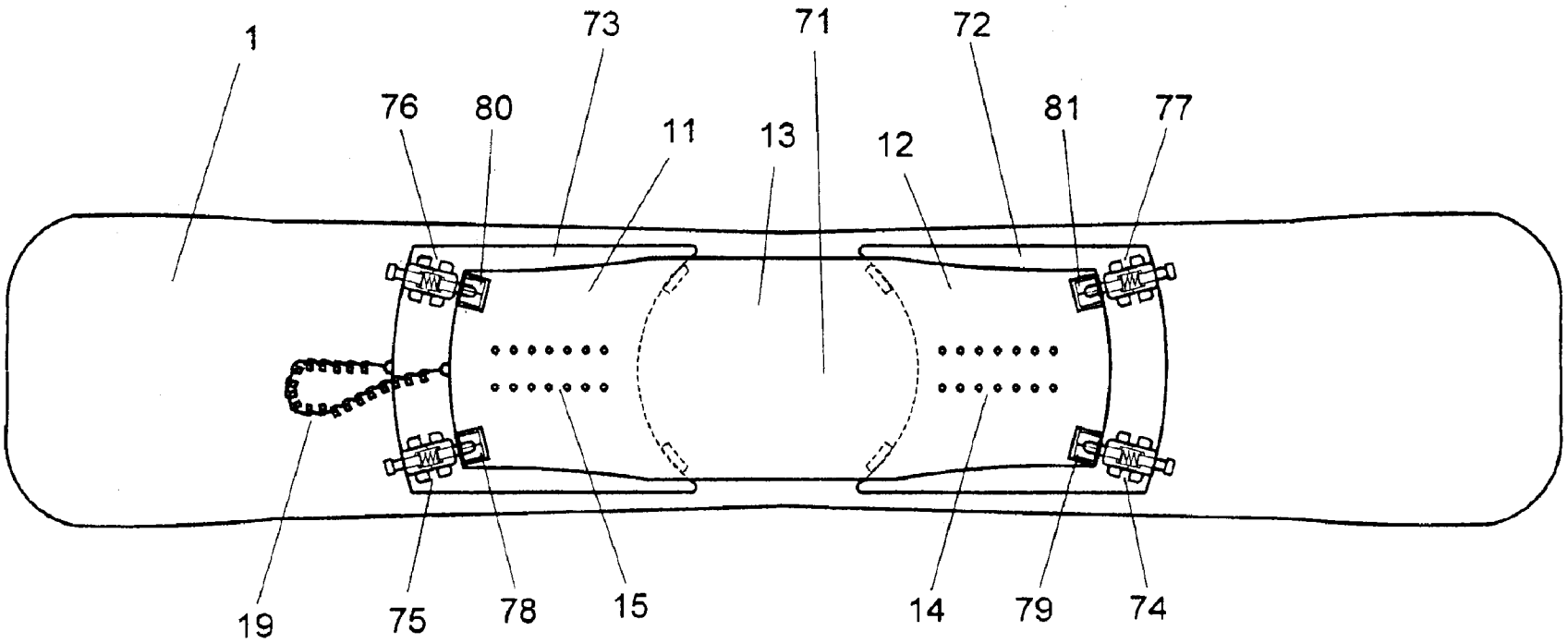
FIG. 11 is a top view of another preferred embodiment of the disclosed invention that better accommodates longitudinal bending, viewed mounted on a snowboard.
Figure 12:
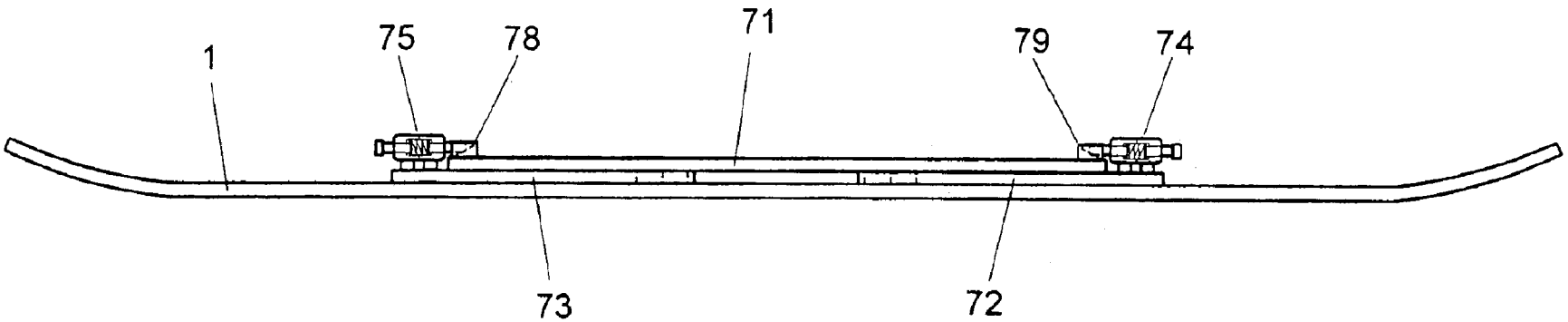
FIG. 12 is a side view of a preferred embodiment of the disclosed invention that better accommodates longitudinal bending, viewed mounted on a snowboard.
Figure 13:
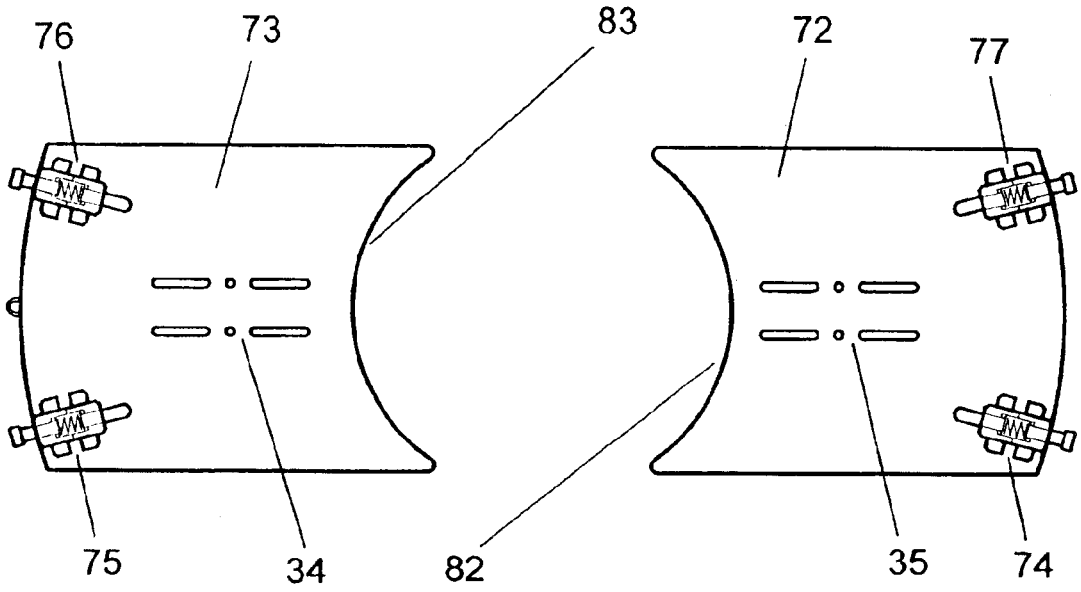
FIG. 13 is a top view of a platform retention assembly in a preferred embodiment of the disclosed invention that better accommodates longitudinal bending.
Figure 14:
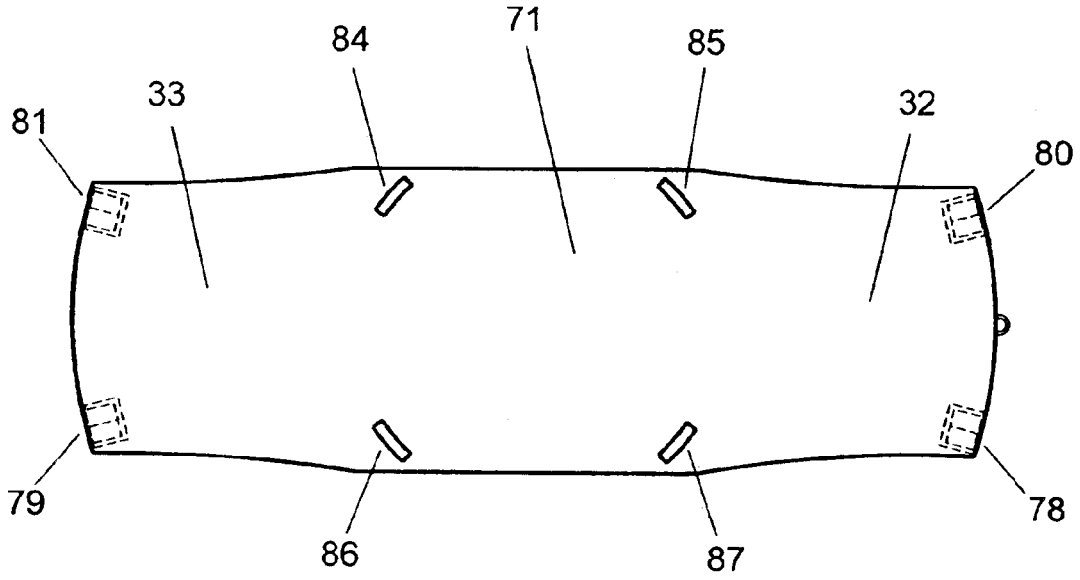
FIG. 14 is an underside view of the binding support platform in a preferred embodiment of the disclosed invention that better accommodates longitudinal bending.

In the preferred embodiment of FIGS. 11–14, the retention plungers of preloaded plunger assemblies 74–77 interface with contours 78–81 that are part of or fastened to binding support platform 71. In the embodiment of FIGS. 11–14, contours 78–81 include facets (similar to facets 52 and 53 shown in FIG. 7) that are oriented so that the interfaces between preloaded plunger assemblies 74–77 and contours 78–81 can resist limited torques about the Z axis and limited separation forces in the Z direction. The interfaces between the retention plungers of preloaded plunger assemblies 74–77 and contours 78–81 of the binding support platform 71 also allow the binding support platform 71 to release from underlying plates 72 and 73 if separation torques or forces encountered while snowboarding exceed a threshold. The threshold is set by the designer's choice of angular orientation for facets in contours 78–81 and by the user's adjustment of each retention plunger's preload force. To prevent runaway of the snowboard in the event of release, the preferred embodiment of FIGS. 11–14 optionally includes leash 19 that is shown in FIG. 11 having one end attached to underlying plate 73 and the other end attached to the binding support platform.

In the preferred embodiment of FIGS. 11–14, binding support platform 71 includes downwardly protruding ribs 84–87 that are part of or are fastened to the underside of region 13 of binding support platform 71. Downwardly protruding ribs 84–87 contact the inner edges 82 and 83 of underlying plates 72 and 73, and thereby prevent binding support platform 71 from translating purely in the X-Y plane relative to the snowboard. Inner edges 82 and 83 of underlying plates 72 and 73 are curved and arranged so that contacts with downwardly protruding ribs 84–87 are all tangent about one mutual center point and so do not, by themselves, prevent rotation of binding support platform 71 about the Z axis relative to the snowboard.

In an alternative embodiment, the radius of curvature of inner edges 82 and 83 could be reduced such that inner edges 82 and 83 form the common inner edge of a large circular hole in a single underlying plate formed by the joining of underlying plates 72 and 73 along their lateral edges. However, the separation of underlying plates 72 and 73 in the preferred embodiment of FIGS. 11–14 is desirable because that separation enhances longitudinal flexibility. In another alternative embodiment, downwardly protruding ribs 84–87 could be removed from region 13 of binding support platform 71, being replaced by upwardly protruding ribs or pegs attached to and rising from underlying plates 72 and 73 adjacent to preloaded plunger assemblies 74–77 (or as part of the housing of each preloaded plunger assembly). However, the more central location of ribs 84–87 in the preferred embodiment of FIGS. 11–14 is desirable because it allows mating edges 82 and 83 to have more curvature while still being in circular arrangement to permit rotation about the Z axis. Sufficient curvature of inner edges 82 and 83 enables ribs 84–87 to effectively resist pure lateral translation of binding support platform 71 relative to the snowboard.

In the preferred embodiment of FIGS. 11–14, downwardly protruding ribs 84–87 also optionally perform a helpful function as a positioning template when underlying plates 72 and 73 are fastened to the snowboard. During one optional procedure for fastening underlying plates 72 and 73 to the snowboard, underlying plate 73 is first firmly fastened to the snowboard using the through holes in group 34, while underlying plate 72 is temporarily loosely fastened to the snowboard using the through slots in its group 35. Next, the adjustable preload forces of plunger assemblies 74–77 are temporarily reduced as much as possible. Next, binding support platform 71 is positioned over the firmly fastened underlying plate 73 so that downwardly protruding ribs 85 and 87 are in simultaneous contact with inner edge 83. Next, underlying plate 72 is slid under binding support platform 71 until it is positioned such that inner edge 82 is in simultaneous contact with downwardly protruding ribs 84 and 86. Next, underlying plate 72 is held in position while binding support platform 71 is temporarily removed, and the fasteners fastening underlying plate 72 to the snowboard are tightened.

Figure 15:
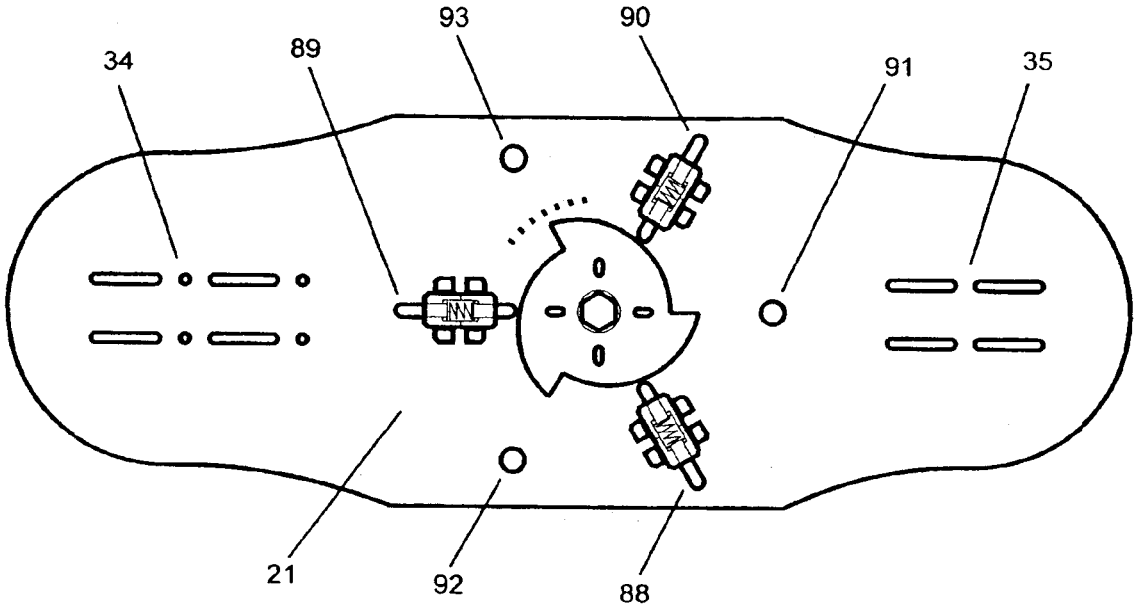
FIG. 15 is a top view of the platform retention assembly of a lower cost alternative embodiment of the disclosed invention.
Figure 16:
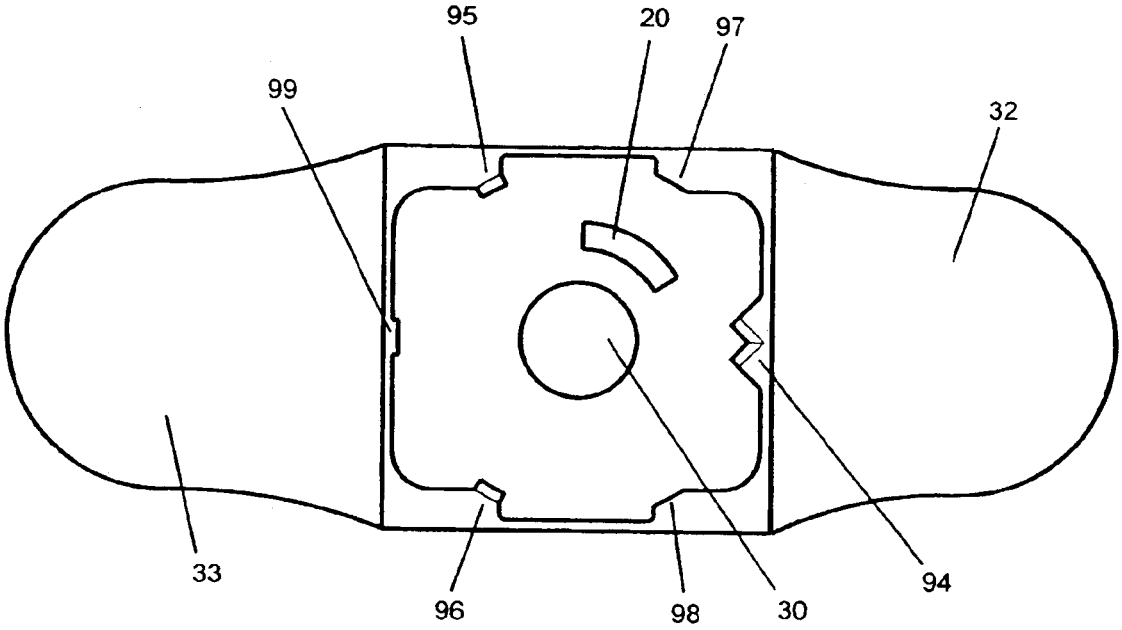
FIG. 16 is an underside view of the binding support platform of a lower cost alternative embodiment of the disclosed invention.

The preferred embodiments shown in FIGS. 5–8, FIG. 10, and FIGS. 11–14 all include four preloaded plunger assemblies. An alternative embodiment, illustrated in FIGS. 15 and 16, includes only three preloaded plunger assemblies positioned with greater average angular separation. The alternative embodiment of FIGS. 15 and 16 is less costly because it has fewer parts. However, the use of four preloaded plunger assemblies has a performance advantage because it allows a configuration where a retention plunger interface can be located near each interior corner of the binding support platform (in the case of the embodiments of FIGS. 5–8 and FIG. 10) or exterior corner of the binding support platform (in the case of the embodiment of FIGS. 11–14). Locating the interfaces near the corners spreads the torque transfer locations, increasing the leverage with which the snowboarder can apply out-of-plane torques through the safety device to the snowboard. Such an increase in leverage gives the snowboarder better control over the snowboard under normal operating conditions.

FIG. 15 illustrates a platform retention assembly in a lower-cost alternative embodiment having three preloaded plunger assemblies, and FIG. 16 illustrates a binding support platform in that lower-cost alternative embodiment. Referring now to FIG. 15, it can be seen that the platform retention assembly of this alternative embodiment includes three retention plungers 88–90. Retention plungers 88, 89, and 90 interface with interior contours 96, 94, and 95 of the binding support platform, respectively. Interior contour 94 includes facets that form a relative angle less than 180° in the X-Y plane in order to enable the interface between interior contour 94 and retention plunger 89 to resist rotation of the binding support platform about the Z axis relative to the platform retention assembly. The facets of interior contour 94 are also tilted relative to the Z axis in order to enable the interface between interior contour 94 and retention plunger 89 to resist vertical separation of the binding support platform relative to the platform retention assembly. Interior contours 95 and 96 optionally do not include facets that form a relative angle less than 180° in the X-Y plane. Therefore, in the embodiment shown, interior contours 95 and 96 can not by themselves resist rotation of the binding support platform about the Z axis relative to the platform retention assembly. Interior contours 95 and 96 include facets tilted relative to the Z axis that enable the interfaces between interior contours 95, 96 and retention plungers 88, 90 to resist vertical separation of the binding support platform relative to the platform retention assembly.

In the alternative embodiment of FIG. 15, ribs 36–39 have been replaced by three vertical pegs 91–93 which serve to prevent translation of the binding support platform in the X-Y plane, relative to the platform retention assembly. Pegs 91, 92, and 93 contact interior surfaces 99, 98, and 97 of the binding support platform, respectively. Pegs 91, 92, and 93 are in circular arrangement and therefore do not, by themselves, prevent rotation about the Z axis of the binding support platform relative to the platform retention assembly.

Figure 17:
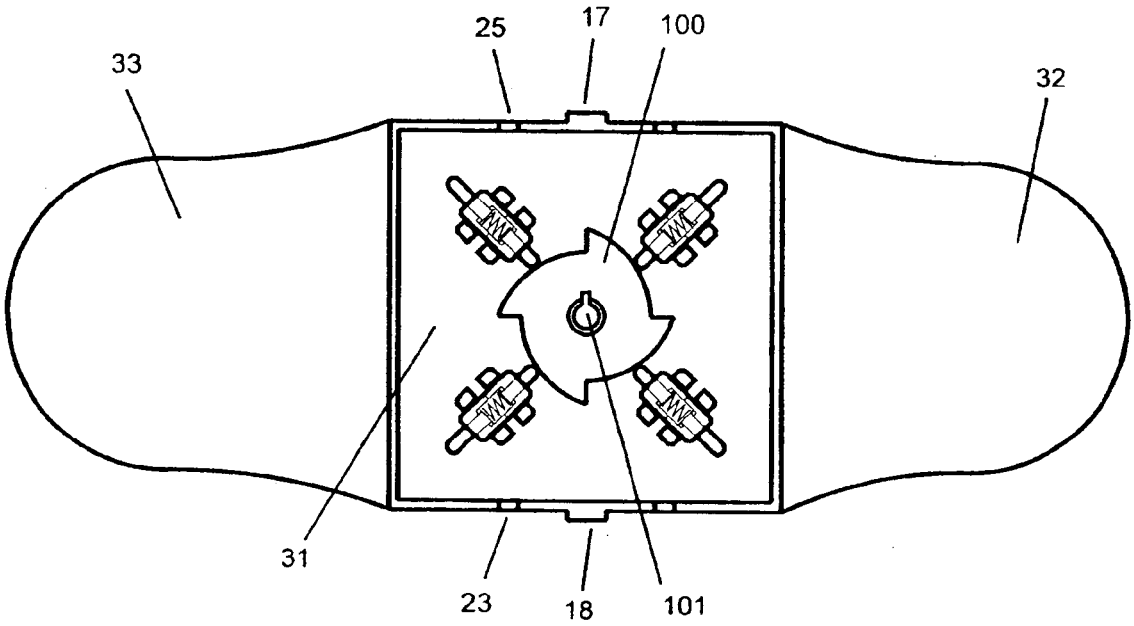
FIG. 17 is an underside view of the binding support platform of a preferred embodiment of the disclosed invention in which the binding support platform and most of the retention mechanism form a single assembly.

The preferred embodiments shown in FIGS. 5–8, FIG. 10, FIGS. 11–14, and FIGS. 15–16 all include retention plunger assemblies that are fastened to a plate that is fastened to the snowboard. However, in another preferred embodiment, the retention plunger assemblies are fastened to the binding support platform so that the binding support platform and retention plunger assemblies would constitute a single assembly, and that single assembly would interface with contours or facets fastened to the snowboard. FIG. 17 is an underside view of the binding support platform in a preferred embodiment of the disclosed invention in which the binding support platform and most of the retention mechanism form a single assembly. In the preferred embodiment shown in FIG. 17, retention plunger assemblies are fastened to cover surface 31 on the underside of region 13 of the binding support platform.

In the preferred embodiment shown in FIG. 17, adjustment cam 100 does not have slots similar to slot 49 shown in FIG. 7. Adjustment cam 100 of FIG. 17 does not require slots because the user is able to rotate and lock adjustment cam 100 by means of a knob and locking mechanism on the other side of cover 31 (i.e. on the top surface rather than underside of region 13 of the binding support platform). The knob controls the angular position of adjustment cam 100 via keyed shaft 101 which passes through cover surface 31.

Figure 18:
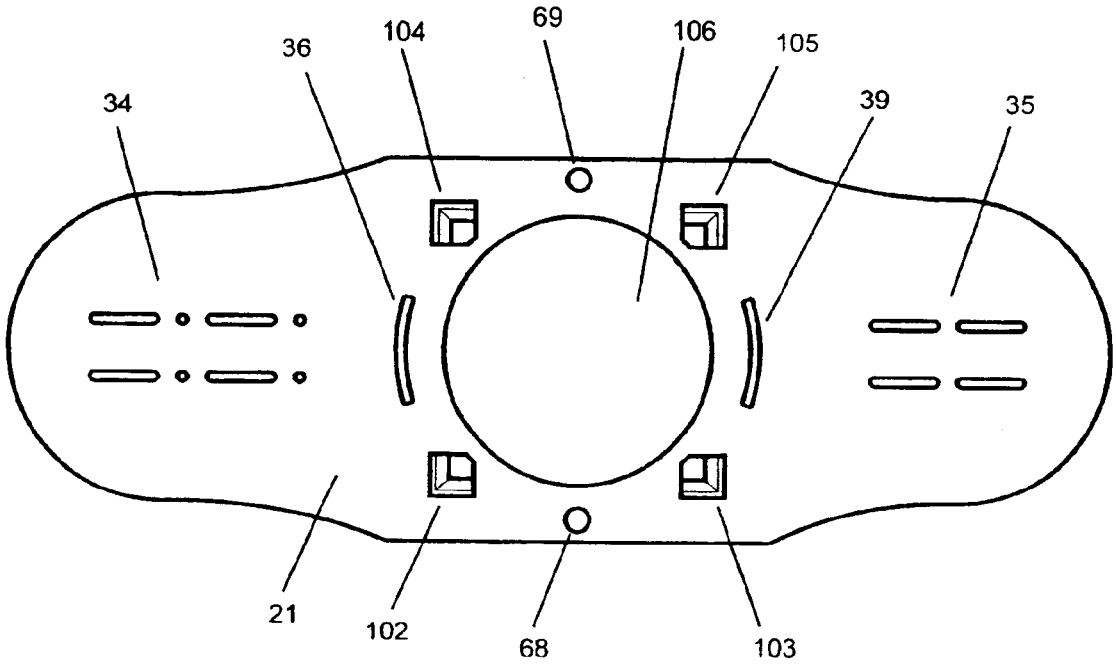
FIG. 18 is a top view of the platform retention plate of a preferred embodiment of the disclosed invention in which the binding support platform and most of the retention mechanism form a single assembly.

FIG. 18 is a top view of platform retention plate 21 in a preferred embodiment of the disclosed invention in which the binding support platform and most of the retention mechanism form a single assembly. Retention contours 102–105 rise from the surface of retention plate 21 and interface with retention plungers of the binding support platform assembly. Retention plate 21 optionally includes large hole 106 in the embodiment of FIG. 18 in order to enhance longitudinal flexibility.

Figure 19:
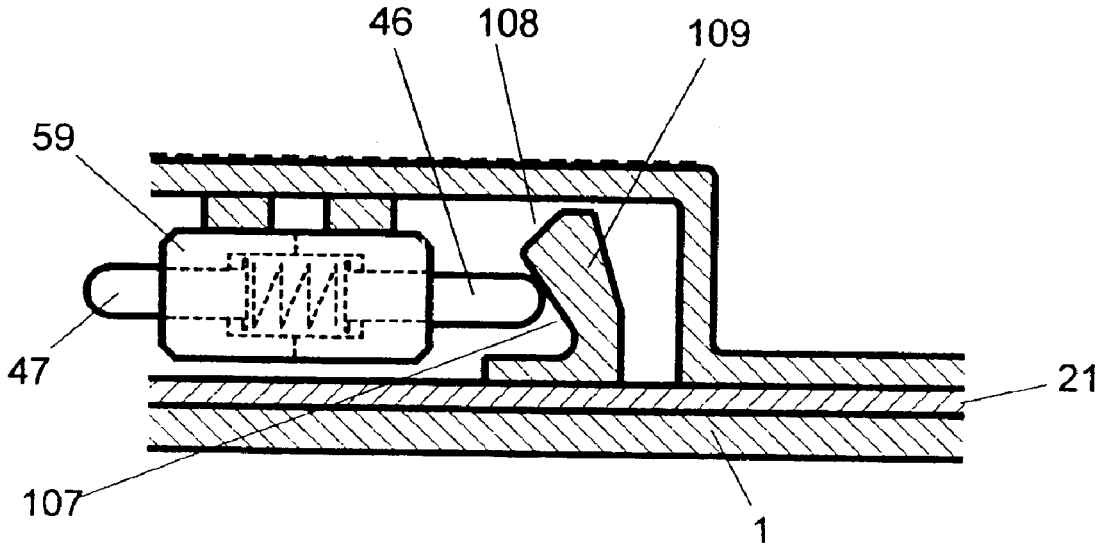
FIG. 19 is a simplified side-view cross-sectional illustration of the interface between the binding support platform assembly and one retention contour on the platform retention plate, in a preferred embodiment of the disclosed invention in which the binding support platform and most of the retention mechanism form a single assembly.

FIG. 19 is a simplified side-view cross-sectional illustration of the interface between the binding support platform assembly and one retention contour on the platform retention plate in a preferred embodiment of the disclosed invention in which the binding support platform and most of the retention mechanism form a single assembly. FIG. 19 is simplified in the same manner and aspects as previously described with regard to FIG. 9. Referring now to FIG. 19, retention contour 109 is fastened to, or part of, platform retention plate 21. The retention plunger assembly that includes retention plunger 46 is fastened to region 13 of the binding support platform. Facet 107 of retention contour 109 is tilted with respect to the vertical (Z) axis. The angle of vertical tilt of facet 107 significantly affects the vertical separating force required to separate the binding support platform from platform retention plate 21. Facet 108 of retention contour 109 is tilted with respect to the Z axis so as to enable forcible reattachment of the binding support platform assembly on to the snowboard without requiring the user to first unlock and rotate cam 100. To accomplish forcible reattachment, the user first positions the binding support platform assembly over the platform retention plate such that retention plunger 46 is resting on top of facet 108. Next, the user presses the binding support platform down so that retention plunger 46 is momentarily forced to the left (as viewed in FIG. 19), and then, as the retention plunger again moves to the right, the point of contact between retention plunger 46 and the retention contour 109 moves from facet 108 to facet 107.

The foregoing description of embodiments of the invention has been presented to provide illustration and description of practical applications of the principles of the invention sufficient to enable one of ordinary skill in the art to utilize the invention in various embodiments and with various modifications as are suited to the particular use contemplated. The embodiments described are not intended to be exhaustive or to limit the invention to the precise forms disclosed; on the contrary, the scope of the present invention is limited only by the terms of the appended claims.

I claim:

1. In snowboarding equipment that includes a snowboard, two boots, one boot for each of two feet of a snowboarder, and two bindings, each binding designed to secure one boot to the snowboard, a safety device comprising:

a binding support platform fashioned to enable fastening of both bindings, the bindings being fastened to the binding support platform rather than to the snowboard; and a platform retention assembly that is fashioned to be fastened to the snowboard;

the platform retention assembly including a plurality of preloaded compliant members that form interfaces with contours on the binding support platform;

said interfaces preventing the binding support platform from separating from the platform retention assembly except when a force or torque applied to the snowboard exceeds a set threshold; and the platform retention assembly including a plurality of firm features that contact firm mating features of the binding support platform, said plurality of firm features including all such firm features on the platform retention assembly that contact firm mating features of the binding support platform;

said firm features and firm mating features being arranged such that the contacts between them that limit relative in-plane translation, when projected onto the plane of the snowboard, are all tangent about one mutual center point; and wherein all of the preloaded compliant members of said platform retention assembly are located in an inner region between the bindings, and wherein the binding support platform includes a surface that covers or partially covers the preloaded compliant members of the platform retention assembly.

2. In snowboarding equipment that includes a snowboard, two boots, one boot for each of two feet of a snowboarder, and two bindings, each binding designed to secure one boot to the snowboard, a safety device comprising:

a binding support platform fashioned to enable fastening of both bindings, the bindings being fastened to the binding support platform rather than to the snowboard; and a platform retention assembly that is fashioned to be fastened to the snowboard;

the platform retention assembly including a plurality of preloaded compliant members that form interfaces with contours on the binding support platform;

said interfaces preventing the binding support platform from separating from the platform retention assembly except when a force or torque applied to the snowboard exceeds a set threshold; and the platform retention assembly including a plurality of firm features that contact firm mating features of the binding support platform, said plurality of firm features including all such firm features on the platform retention assembly that contact firm mating features of the binding support platform;

said firm features and firm mating features being arranged such that the contacts between them that limit relative in-plane translation, when projected onto the plane of the snowboard, are all tangent about one mutual center point; and wherein all of the preloaded compliant members of said platform retention assembly are located in an inner region between the bindings, and wherein said firm features of the platform retention assembly are firm features of one or more plates that are components of the platform retention assembly.

3. The safety device of claim 2, wherein said one or more plates includes at least two distinct underlying plate pieces, each being fastened to the snowboard.

4. The safety device of claim 3, wherein at least two of the distinct underlying plate pieces are in sliding contact with each other at a joint that permits relative longitudinal motion but constrains relative lateral or vertical motion.

5. In snowboarding equipment that includes a snowboard, two boots, one boot for each of two feet of a snowboarder, and two bindings, each binding designed to secure one boot to the snowboard, a safety device comprising a binding support platform assembly and, at least one platform retention plate fashioned to be fastened to the snowboard, wherein the binding support platform assembly includes a binding support platform fashioned to enable fastening of both bindings, the bindings being attached to the binding support platform rather than to the snowboard, and a plurality of preloaded compliant members that form interfaces with contours on the platform retention plate, said interfaces preventing the binding support platform assembly from separating from the platform retention plate except when a force or torque applied to the snowboard exceeds a set threshold, and wherein the platform retention plate includes one or more firm features that contact one or more firm mating features of the binding support platform assembly, said one or more firm features including all such firm features on the platform retention plate that contact firm mating features of the binding support platform assembly;

said firm features and firm mating features being arranged such that the contacts between them that limit relative in-plane translation, when projected onto the plane of the snowboard, are all tangent about one mutual center point.

6. The safety device of claim 5, wherein all of the preloaded compliant members of said binding support platform assembly are located in an inner region between the bindings.

7. The safety device of claim 5 wherein said contours include facets that facilitate forcible reattachment of the binding support platform assembly onto the platform retention plate.

8. The safety device of claim 5, wherein the preloaded compliant members of said binding support platform assembly are located in two peripheral regions, one peripheral region located closer to the leading edge of the snowboard than either of the bindings, and the other peripheral region located closer to the trailing edge of the snowboard than either of the bindings.

9. The safety device of claim 5 wherein said platform retention plate comprises at least two distinct plate pieces, each being fastened to the snowboard.

10. The safety device of claim 5 having two platform retention plates that are not in contact with each other.

11. The safety device of claim 5 wherein the platform retention assembly includes three or more preloaded compliant members.

12. The safety device of claim 5, wherein the binding support platform includes a surface that covers or partially covers the preloaded compliant members of the binding support platform assembly.

13. The safety device of claim 6, wherein each preloaded compliant member provides a force to one or more of said interfaces and all of the forces can be simultaneously adjusted by adjusting the position of one centrally located component.

14. The safety device of claim 9 wherein at least two of the distinct plate pieces are in sliding contact with each other at a joint that permits relative longitudinal motion but constrains relative lateral or vertical motion.

* * * * *